United States Patent [19]

Buys et al.

[11] 4,316,606

[45] Feb. 23, 1982

[54] APPARATUS FOR SEPARATING AND EXTRACTING STACKED SHEETS ONE BY ONE

[75] Inventors: Henri Buys, Breux Jouy; Camille Carisey, Creteil, both of France

[73] Assignee: Societe Anonyme dite: Transaccompagnie pour le Developpement des Transactions Automatiques, Paris, France

[21] Appl. No.: 138,302

[22] Filed: Apr. 8, 1980

[30] Foreign Application Priority Data

Apr. 10, 1979 [FR] France ..... 79 09035

[51] Int. Cl.[3] ..... B65H 3/52

[52] U.S. Cl. ..... 271/10; 271/122; 271/125

[58] Field of Search ..... 271/10, 110, 111, 114, 271/122, 125

[56] References Cited

U.S. PATENT DOCUMENTS

| | | | |
|---|---|---|---|
| 3,042,397 | 7/1962 | Tarbuck | 271/51 |
| 3,184,231 | 5/1965 | Varrichio | 271/36 |
| 4,158,456 | 6/1979 | Holland-Letz | 271/122 X |
| 4,212,456 | 7/1980 | Ruenzi | 271/110 X |

FOREIGN PATENT DOCUMENTS

| | | |
|---|---|---|
| 2108495 | 5/1972 | France . |
| 2177747 | 11/1973 | France . |
| 2307738 | 11/1976 | France . |
| 2310948 | 12/1976 | France . |
| 2315470 | 1/1977 | France . |

*Primary Examiner*—Richard A. Schacher
*Attorney, Agent, or Firm*—Kenyon & Kenyon

[57] ABSTRACT

Apparatus for separating and extracting stacked sheets one by one, in which the top sheet is driven by a friction roller only forward in the extraction direction and is passed between two rollers 6, 9 which have suitable profiles to curve it transversely at least once. Roller 6 rotates with the friction roller, while roller 9 is permitted only a few degrees of rotation in the forward direction and is then spring-returned, preferably to slightly beyond its initial position; so that the roller 9 indexes slightly in the counterfeed direction with each dispensing cycle, thereby evenly distributing wear around its periphery.

The invention applies in particular to bank-note extractors.

7 Claims, 3 Drawing Figures

APPARATUS FOR SEPARATING AND EXTRACTING STACKED SHEETS ONE BY ONE

The present invention relates to apparatus for separating and extracting stacked sheets one by one.

Numerous arrangements of the above type are known and in particular the applicant has designed an extractor which includes a drive roller, said roller resting with some pressure against the top of the stack (see French Pat. No. 2,231,221).

The top sheet of the stack is extracted in two stages. During the first stage, the roller is rotated so as to move back the top sheet to release it from a device here called a sheet-stripper, constituted by a small flexible and resilient blade which rests on the top sheet of the stack, and to curve said top sheet, the trailing edge of which is held back by a roller which exerts some pressure and which can rotate only in the direction which corresponds to the forward movement of the sheet. During the second stage the direction of rotation of the drive roller reverses and moves forward the top sheet of the stack.

Such an extractor operates well at low speeds. However, the alternating rotation of the drive roller in one direction then the other obviously limits the rate of sheet dispensing.

French Pat. No. 2,177,747 describes a machine for moving, separating and stacking sheets in which the sheets are bent into transverse corrugations. This technique makes it possible to separate sheets one by one at a fast rate since the rollers are not required to rotate alternately in opposite directions.

Preferred embodiments of the present invention provide improved apparatus of the type that imparts transverse corrugations the sheets, suitable for high speed dispensing, with very few occasions on which a plurality of sheets are accidentally dispensed simultaneously.

The present invention provides apparatus for separating and extracting stacked sheets one by one, said apparatus including a first roller in contact with the leading edge of the top sheet of the stack and including means for rotating the roller in the direction corresponding to extraction towards the leading edge of the top sheet, characterized in that said first roller free-wheels on a first shaft, in that its rotation drive means rotates said shaft in the free-wheel direction of said first roller and also rotates a second shaft in the same direction, a second roller free-wheeling on said second shaft, said second roller having its axis parallel to the first roller and being located at the leading edge of the stack of sheets, in that a third roller is located parallel to and beneath the second roller but is not in contact therewith so that the top sheet of the stack passes between the second and third rollers, the shapes of the generatrices of the second and third rollers being such that when a sheet passes between these two rollers, it is curved transversely at least once, in that second means for driving towards the leading edge of said sheet are located downstream from said second and third rollers and in that control means are provided for stopping the rotation drive means of the first and second shafts which drive the first and second rollers when the top sheet is driven by said second drive means.

The third roller may be prevented from rotating in the direction which corresponds to the forward drive of the upper sheet, but according to a particularly advantageous embodiment of the invention, the third roller includes means which limit angularly its rotation in the direction which corresponds to the passing of a sheet between the second and third rollers and means for returning it to its initial angular position when said sheet is released from between said two rollers.

Advantageously, the third roller rotates freely in both directions on a third stationary shaft, and said means which limit angularly the rotation of the third roller in the direction which corresponds to the extraction of the sheets include a disc which free-wheels on said stationary shaft, said disc being allowed to free-wheel in the same direction of rotation as the free wheels of the first and second rollers, said disc having a peripheral slot which limits the movement of a stud fixed perpendicularly to the periphery of the third roller and engaging said slot, and the return means includes a return spring fixed firstly to said stud and secondly to said disc so that the force exerted by said spring tends to rotate the third roller in the free-wheel direction of said disc.

According to another feature of the invention, the first and second rollers are each divided into two half-rollers separated by a drive sprocket, the two sprockets being connected by a transmission unit, a fourth roller being fixed to said second shaft and a fifth roller being installed idle on an axle at the end of a lever, said lever including control means for making it rock from a first position in which said fifth roller is suspended in empty space to a second position in which it rests simultaneously on said fourth roller and on a drive motor output unit.

The invention will be better understood from the following description of a preferred embodiment of the invention given with reference to the accompanying drawings, in which.

Figure 1:
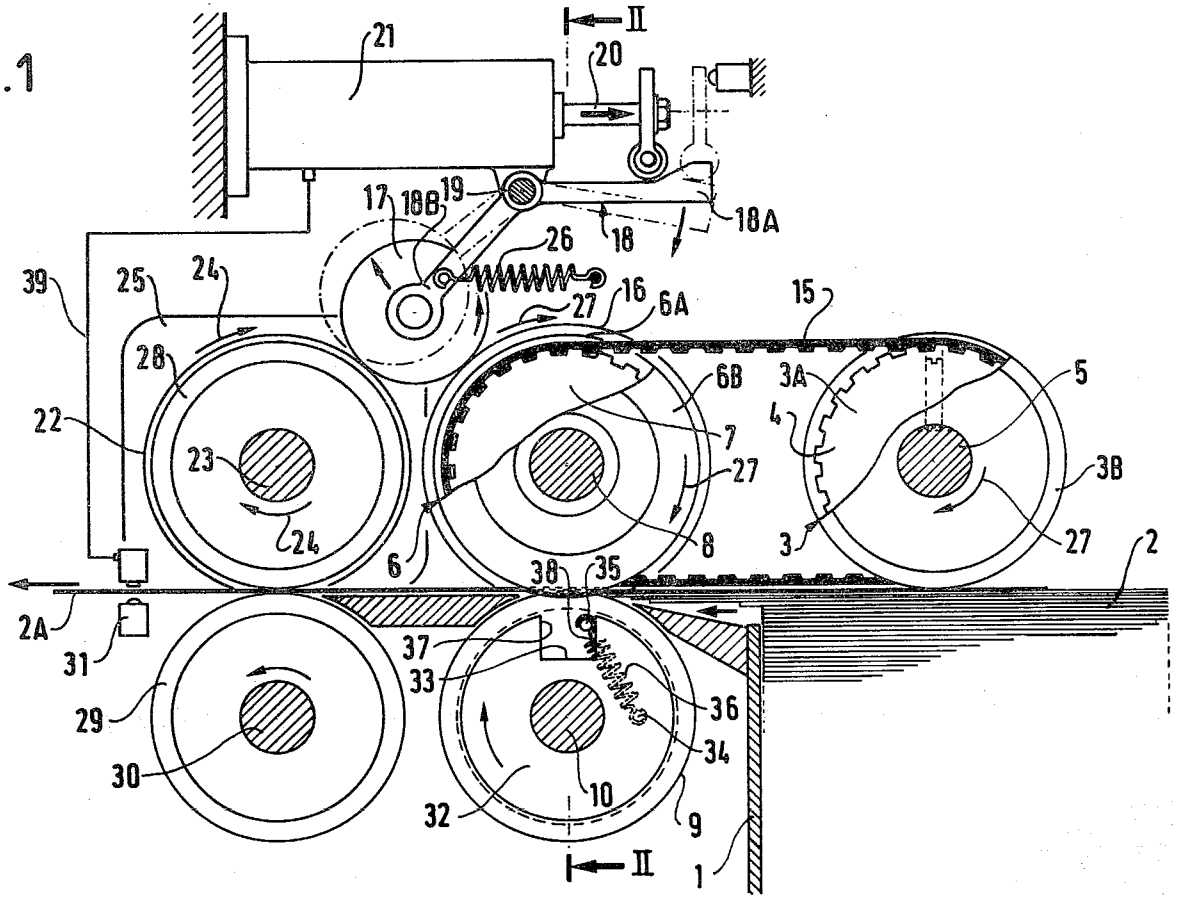
FIG. 1 is a schematic elevation of an apparatus in accordance with the invention for separating and extracting stacked sheets.
Figure 2:
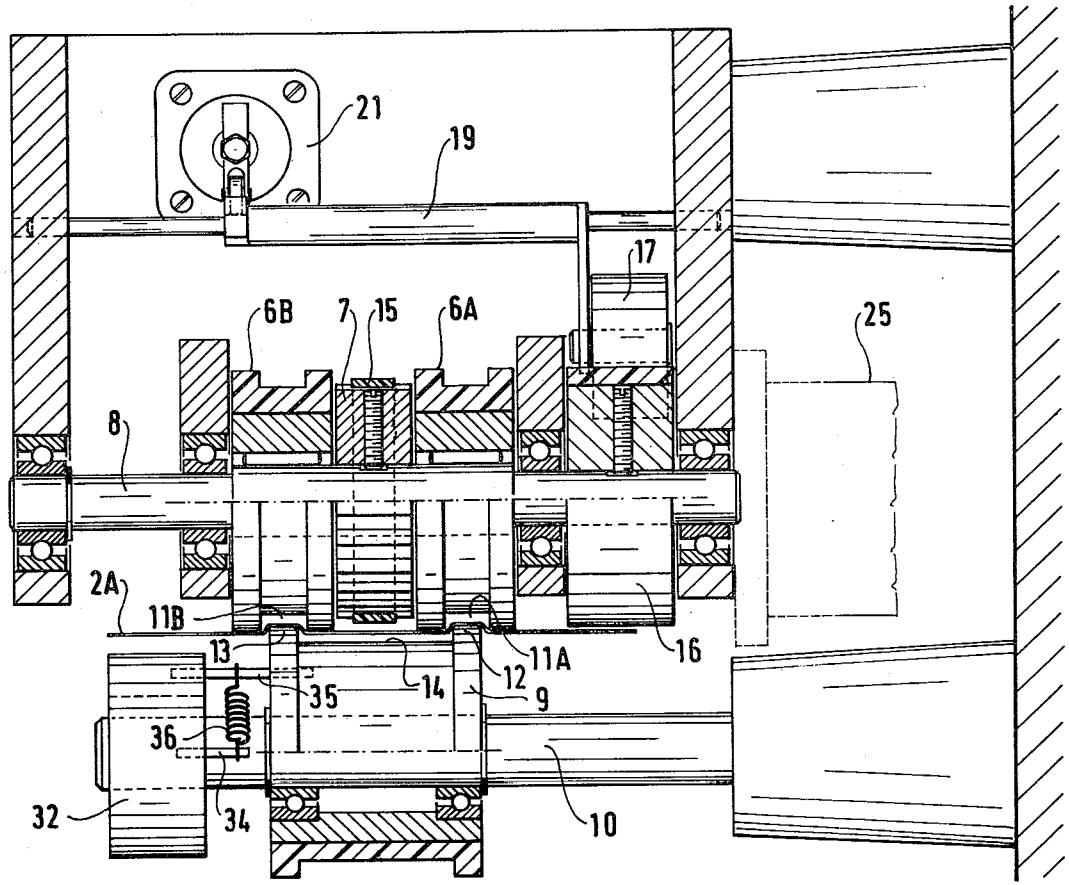
FIG. 2 is a partial cross-section through II—II in FIG. 1.
Figure 3:
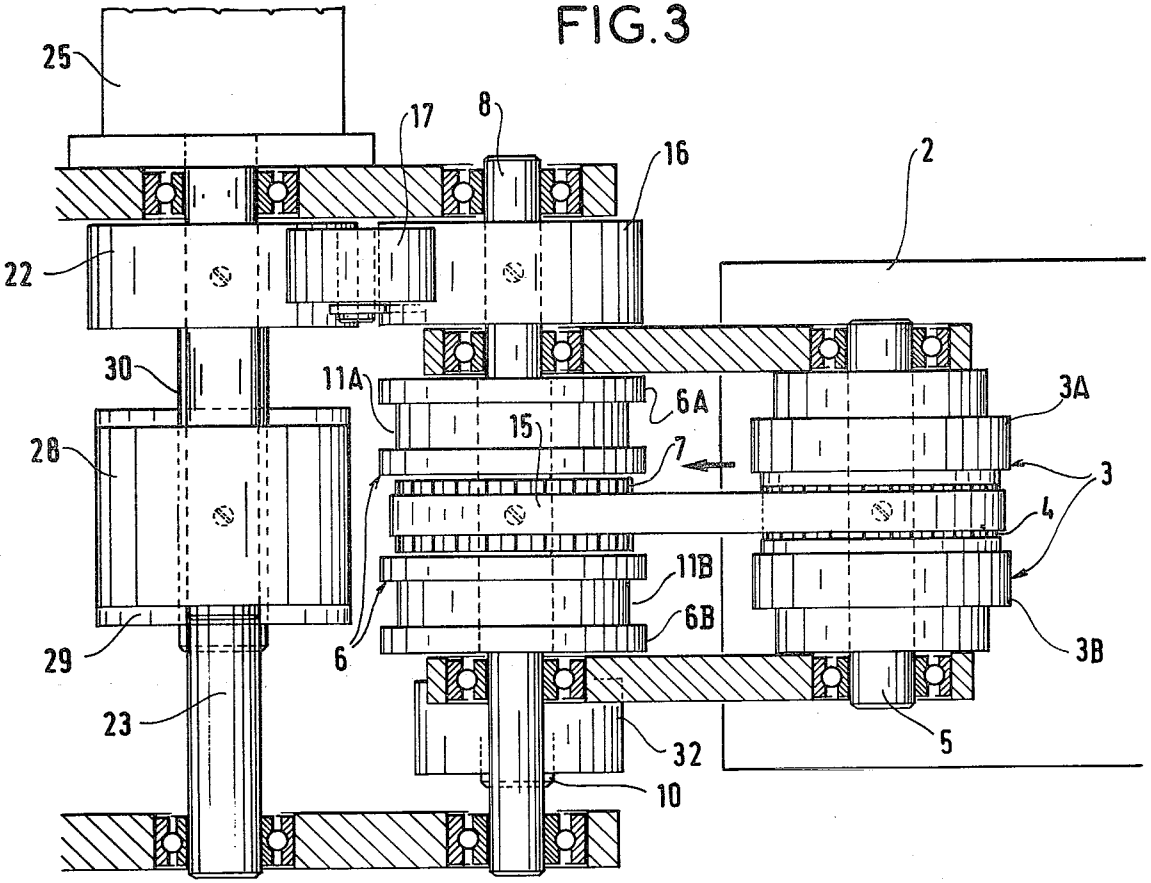
FIG. 3 is a partial plan of FIG. 1.

In the example described, the apparatus separates and extracts bank notes—a purpose for which the invention is particularly advantageous, since it rarely dispenses a plurality of bank notes simultaneously. In the event of such simultaneous dispensing, a detector placed downstream from the apparatus in accordance with the invention directs the excess bank-notes towards a reject receptacle, from which the bank notes are subsequently counted by hand, which makes it desirable to avoid such simultaneous multiple distributions as far as possible. Also, the dispensing capacity of a bank-note dispenser depends on its bank-note storage magazine, and its effective capacity is reduced by the quantity of bank-notes directed to the reject receptacle.

The assembly includes a magazine 1 in which a stack 2 of bank-notes is placed. A first roller 3 separated into two half-rollers 3A and 3B by a first sprocket 4 fixed on a first shaft 5 rests against the top of the stack. The half-rollers 3A and 3B free-wheel on the shaft 5. A second roller 6, also separated into two half-rollers 6A and 6B by a second sprocket 7 fixed on a second shaft 8, is situated parallel to the first roller 3 at the front end of the stack 2 of bank-notes. The half-rollers 6A and 6B free-wheel on the shaft 8. A third roller 9 idles on a third, fixed shaft 10 with an angular rotation limiter for limiting angular rotation in one direction as described hereinafter.

The third roller 9, whose axis is parallel to those of the first and second rollers 3 and 6, is situated at the front end of the stack 2 of bank-notes, under the second roller 6 but not in contact therewith, so that the top bank-note 2A of the stack 2 is situated level with the gap between the second roller 6 and the third roller 9. Each half-roller 6A and 6B has a groove 11A (or 11B) in which one of the ends 12 (or 13) of the third roller (9) enters without touching the bottom of the groove, said third roller also having a wide groove 14 so that a bank-note which passes between the rollers 6 and 9 is transversely curved twice so as to separate the top bank-note of the stack from the following bank-notes.

The two sprockets 4 and 7 are connected by a notched belt 15. A fourth roller 16 is fixed on the second shaft 8, and a fifth roller 17 idles at the end of a bell crank 18 pivoted at 19 and driven by the piston 20 of an engagement controlling electromagnet, the piston pressing against the end 18A and thereby pivoting the crank 18.

In the engaged position, the end 18B of the crank 18 is lowered, as seen in continuous lines in FIG. 1, and the fifth roller 17 rests simultaneously on the fourth roller 16 and on a drive roller 22 which is fixed on a drive shaft 23 which is rotated in the direction of arrows 24 by a motor 25. In this position, a spring 26 causes the fifth roller 17 to exert some pressure on the drive roller 22 and on the fourth roller 16, thereby rotating the first and second shafts 5 and 8 in the direction of the arrows 27 and hence rotating the first and second rollers 3 and 6, which free-wheel, i.e. rotate override freely with respect to these shafts 5 and 8 in the direction of the arrows 24 and 27. In the released position shown in chain-dotted lines in FIG. 1, the end 18B of the crank 18 is raised, and the fifth roller 17 is suspended in empty space.

The drive shaft 23 also carries a second drive roller 28, and a sixth roller 29 is placed beneath said second drive roller and in contact therewith, said sixth roller rotating freely on the shaft 30. Both these rollers—the drive roller 28 and the sixth roller 29—constitute a means for driving the top bank-note 2A of the stack 2 when said bank-note is separated from the others by the assembly which consists of the first roller 3, the second roller 6 and the third roller 9. As soon as the top bank-note 2A is gripped between the drive roller 28 and the sixth roller 29, a photoelectric detector 31 causes the fifth idler roller 17 to be released, and the first roller 3 and the second roller 6 continue to free-wheel on the first shaft 5 and on the second shaft 8 due to the friction exerted between said rollers 3 and 6 and the top bank-note as it is being pulled forward between drive roller 28 and the sixth roller 29.

A connection 39 links the detector 31 to control the electromagnet 21.

When the top bank-note 2A passes between the second roller 6 and the third roller 9, the third roller 9 rotates slightly due to friction between said third roller and the bank-note, but the third roller rotates through only a few degrees since it is stopped by the device described below.

A disc 32 free-wheels on the stationary shaft 10, so that it is free to rotate thereon in the same direction as the free-wheel direction of the first and second rollers 3 and 6, namely, in the direction of the arrows 24 and 27. Said disc 32 is provided with a peripheral slot 33 and a stud 34, also located near the periphery but on another radius of the disc. The third roller 9 has a stud 35 which enters the slot 33 in the disc 32, leaving it a few degrees of play, said stud 35 being fixed perpendicularly to the disc's face and in the neighbourhood the disc's periphery. A return spring 36 connects the stud 35 to the stud 34. Therefore, when a bank-note passes between the second roller 6 and the third roller 9, the third roller 9 rotates due to friction of the bank-note against said roller until the stud 35 abuts against the edge 37 of the slot 33. Then the third roller 9 is locked, since the free wheel of the disc 32 allows said disc to rotate only in the opposite direction (direction of arrows 24 and 27). When the top bank-note is released from between the two rollers 6 and 9, the return spring 36 pulls the third roller 9 back, and when the stud 35 inspects in said backwards movement against the other edge 38 of the slot 33, the disc 32 rotates slightly. This causes the point at which the bank-notes pass over the third roller 9 to be shifted gradually and therefore distributes wear evenly over said roller, thereby greatly reducing such wear.

The first roller 3 and the second 6 are covered with india rubber which has a good coefficient of friction, better than that with which the third roller 9 is covered.

The fact that the third roller rotates slightly forwards allows the top bank-note to be properly engaged, while the fact that it is locked after rotation through a few degrees stops the bank-note which is below it, in the event that it has moved slightly forward. When the roller 9 is rotated backwards while the top bank-note proceeds forward between the rollers 6 and 9, the lower bank-note is pushed rearwards.

The example described applies to the case of a bank-note extractor for which the invention is particularly advantageous, but the invention obviously applies to any sheet separator and sheet extractor.

We claim:

1. Apparatus for feeding sheets one by one in a predetermined direction from a stack of sheets, the apparatus including a magazine for holding a stack of sheets; a first shaft rotatably mounted adjacent to the dispensing side of said magazine; a first roller mounted in free-wheeling relation on said first shaft for frictionally engaging an exposed surface of a first sheet in the magazine; a second shaft rotatably mounted parallel to and downstream in the sheet feeding direction from the first shaft; a second roller mounted in free-wheeling relation on said second shaft for frictionally engaging the same surface of a sheet fed from the magazine by the first roller; first drive means for rotating said first and second shafts in the free-wheeling direction of the first and second rollers to feed a sheet from the first roller towards the second roller; retard means positioned in closely spaced relation to the second roller such that a fed sheet passes between and in contact with the second roller and the retard means for stripping away any sheet stuck to the first sheet; and second drive means positioned downstream from the second roller further feeding each sheet delivered from the second roller, wherein said retard means comprises:

a third roller mounted for rotation about a third axis parallel to the axis of rotation of the second shaft, said third roller having a peripheral surface for frictionally contacting the surface of a fed sheet opposite from said exposed surface;

means for limiting the angular rotation of said third roller in the sheet feeding direction from an initial position when engaged by a sheet being fed by the second roller; and biasing means for rotatably urging said third roller in the reverse direction toward said initial position.

2. Sheet feeding apparatus according to claim 1 wherein said means for limiting the angular rotation of said third roller comprises a member mounted for free-wheeling rotation coaxially with the third roller only in a direction opposed to the sheet feeding direction, angularly spaced limit members fixed to one of said third roller and said further member, and a stop member mounted on the other of said third roller and said further member for abutment against said limit members to confine the rotation of said third roller relative to said further member to the angle between said limit members; and said biasing means comprises a spring connected between the third roller and the member.

3. Sheet feeding apparatus according to claim 1 or 2 wherein the shapes of the generatrices of the second and third rollers are such as to transversely curve at least once a sheet being fed between said second and third rollers.

4. Sheet feeding apparatus according to claim 1 or 2, further comprising means for disengaging said first drive means from the first and second shafts when a sheet is being fed by said second drive means.

5. Sheet feeding apparatus according to claim 2 wherein said member comprises a disc disposed adjacent to one end of said third roller, said angularly spaced limit members comprise the opposite ends of a slot in the periphery of said disc, and said stop member comprises a stud extending from the one end of the third roller into said slot.

6. Sheet feeding apparatus according to claim 2 wherein the coefficient of friction of the circumferential surface of the third roller with respect to the surface contacted by said third roller of a sheet being fed is less than the coefficient of friction of the circumferential surface of the second roller with respect to the surface contacted by said second roller of a sheet being fed.

7. Sheet feeding apparatus according to claim 1 or 2 or 5 or 6 wherein said first drive means comprises a first drive sprocket fastened to said first shaft, a second drive sprocket fastened to said second shaft, a transmission unit connecting said first and second drive sprockets, a fourth roller fixed to said second shaft, a lever pivoted about an axis parallel to the second shaft, a drive motor output unit, and a fifth, idler roller mounted on said lever, said lever being movable from a first position in which said roller simultaneously engages the drive motor output unit and the fourth roller and a second position in which the fifth roller is disengaged from at least one of said drive motor output unit and the fourth roller.

* * * * *

UNITED STATES PATENT AND TRADEMARK OFFICE

CERTIFICATE OF CORRECTION

PATENT NO. : 4,316,606

DATED : 23 February 1982

INVENTOR(S) : Henri Buys et al.

It is certified that error appears in the above—identified patent and that said Letters Patent is hereby corrected as shown below:

Column 1, line 36: after "corrugations" insert --to--.

Column 3, line 31: change "rotate override" to --over ride--.

Column 4, line 3: after "neighborhood" insert --of--.

Column 4, line 14: change "inspects" to --impacts--.

Column 4, line 20: after "second" insert --roller--.

Column 6, line 21: after "which said" insert --fifth--.

Signed and Sealed this

*Twenty-fifth* Day of *May 1982*

[SEAL]

*Attest:*

GERALD J. MOSSINGHOFF

*Attesting Officer*

*Commissioner of Patents and Trademarks*